United States Patent [19]

Bunz et al.

[11] Patent Number: 4,871,101

[45] Date of Patent: Oct. 3, 1989

[54] BACK-PACK FRAME

[75] Inventors: Rosa Bunz; Christine Dzionara, both of Radstadt; Karl Tömpe, Hallein-Neualm, all of Austria

[73] Assignee: Maschinenvertrieb Kohlbrat & Bunz Gesellschaft mbH, Radstadt, Austria

[21] Appl. No.: 31,469

[22] PCT Filed: Mar. 28, 1986

[86] PCT No.: PCT/AT86/00025

§ 371 Date: Feb. 24, 1987

§ 102(e) Date: Feb. 24, 1987

[87] PCT Pub. No.: WO87/00013

PCT Pub. Date: Jan. 15, 1987

[30] Foreign Application Priority Data

Jun. 28, 1985 [AT] Austria ..... 1925/85
Nov. 5, 1985 [AT] Austria ..... 3182/85

[51] Int. Cl.[4] ..... A45F 4/00; A45F 4/08

[52] U.S. Cl. ..... 224/153; 224/156; 224/210; 280/20; 280/30

[58] Field of Search ..... 224/153, 156, 151, 210; 5/114; 280/20, 30

[56] References Cited

U.S. PATENT DOCUMENTS 3,158,299 11/1964 Weir et al. ..... 224/153
3,355,186 11/1967 Bradley .
3,693,849 9/1972 Knubenbauer .
3,730,407 5/1973 Russell .
3,897,894 8/1975 Lawrence .

FOREIGN PATENT DOCUMENTS 2339199 2/1975 Fed. Rep. of Germany .
2108434 5/1972 France .
2520610 8/1983 France .
134213 10/1929 Switzerland .
626519 11/1981 Switzerland .
1430597 3/1976 United Kingdom .

*Primary Examiner*—Harvey C. Hornsby
*Assistant Examiner*—Joseph S. Machuga
*Attorney, Agent, or Firm*—Lorusso & Loud

[57] ABSTRACT

A back-pack frame (1) intended for moving loads has longitudinal beams (3, 4) and cross beams (10, 13), carrying straps, load-securing elements, and coupling elements (17, 18) that make it possible to arrange two such back-pack frames (1) end-to-end, so as to form a platform that can be either carried or pulled along the ground. Four longitudinal beams (3, 4) are arranged so as to correspond approximately to the edges of a prism having a trapezoidal base, the longitudinal beams (3) being arranged at a greater distance from each other on the carrier side. The two load-side longitudinal beams (4) define a sliding plane, and on the two narrow sides of the back-pack frame (1) there is at least one holding element (6) for a shackle (7) that protrudes beyond the load-side longitudinal beams (4). On each carrier-side longitudinal beam (3) above the lowest element (6), there is at least one side-wall element (9) that is of flexible material. Side-wall elements (9) that are opposite each other on the two carrier-side longitudinal beams (3) are configured so as to be joinable to form a covering on either the load side or the carrier side. It is preferred that a slide plate (5) be arranged between the load-side longitudinal beams (4), the load-side longitudinal beams forming edge runners in the slide plate (5).

22 Claims, 5 Drawing Sheets

BACK-PACK FRAME

Figure 1:
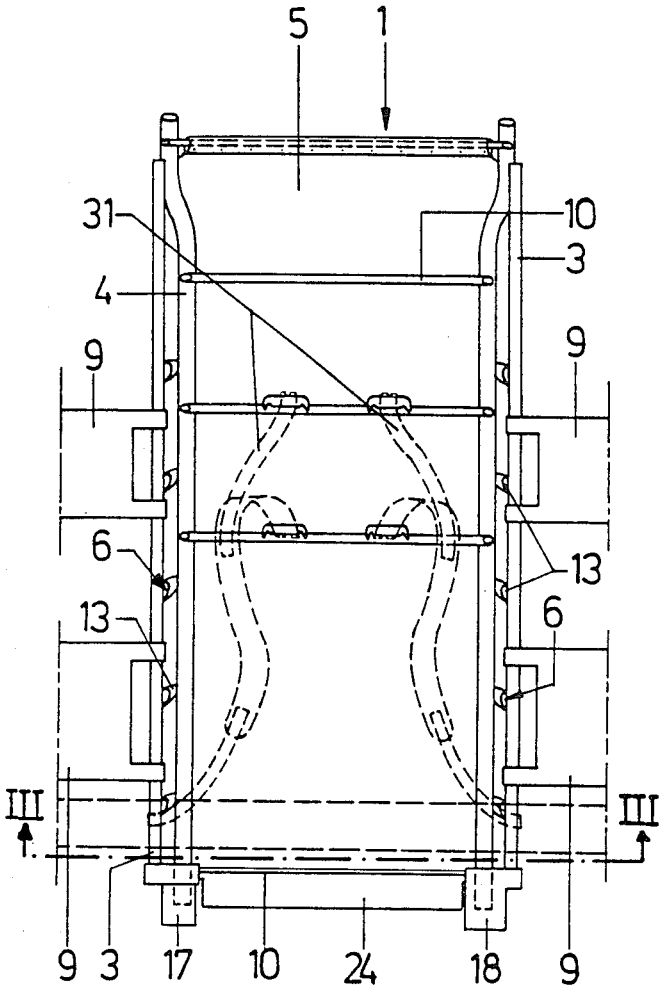

The present invention relates to a back-pack frame for carrying loads, having longitudinal beams, and cross beams, carrying straps and load-securing elements, and having coupling elements that make it possible to arrange two such back-pack frames end-to-end so as to form a platform that can be either carried or pulled along the ground, four longitudinal beams being provided in a spatial arrangement, and one pair of longitudinal beams defining a sliding plane.

A back-pack frame of this kind is described in DE-OS 23 39 199. This back-pack frame is provided with various coupling elements, so that other possible applications result, if at least two of the frames of this kind are coupled together, such applications being, for example, stretchers, sleds, single or multi-wheeled vehicles, etc.

The present invention aims to provide a back-pack frame that not only premits additional possible applications by the combination of two back-pack frames, but which is also better suited for any application, when used as a back-pack frame and can be doubled for any purpose. In particular, these improvements apply to the manner in which loads to be transported are secured to the back-pack frame and to the transport characteristics, so that the apparatus is similar to a rucksack, a stretcher or litter, and a sled.

According to the present invention, this problem is solved in that the four longitudinal beams are arranged so as to correspond approximately to the edges of a prism and form a carrier-side pair and load-side pair, the two load-side longitudinal beams defining the sliding plane that on the two narrow sides of the back-pack frame that contain in each instance a longitudinal beam of both pairs there is at least one holding element for a removable shackle that extends beyond the load-side longitudinal beam, and that on each carrier-side longitudinal beam above the lowest holding element there is at least one side-wall element that is of flexible material, and each side-wall element of the one carrier-side longitudinal beam being connectable with a side-wall element of the other carrier-side longitudinal beam so as to form a carrier - as well as a load-side covering.

This provides for a back-pack carrier frame in which the spatial arrangement of the four longitudinal beams forms a hollow space that accommodates the normal support-belt tensioning and attachment, but does not accommodate the load. This means that the width of the narrow sides is small, which results in great user comfort. When used for back-packing, the load area lies outside the sliding plane and is of variable volume. The shackles are secured to the narrow sides, which is to say to the sides, since the configuration of the holding elements can be in any form that is desired at this location. A plurality of holding elements can be arranged one above the other, which means that the shackles can be adjusted for height, and also means that it is possible to provide two or more shackles above each other. The sliding plane that is required when the apparatus is used as a sled is not interrupted, so that the sled has very good sliding characteristics. In this arrangement the simple back-pack frame can be used as a small individual sled, and two back-pack frames arranged one behind the other to be mirror images of each other can be used as a bigger transport- or rescue sled. When the back-pack frame is used as a rucksack, the load can be fixed at the load-side, when it is used as a sled or stretcher, the load or the person to be transported can be fixed at the carrier-side by means of the flexible side-wall elements, in this instance, too, a load area of variable volume lying substantially outside the hollow space formed by the longitudinal beams. Since preferably a plurality of holding elements are provided, which may not of course be covered by the side-wall elements, it is preferred that several side-wall elements be arranged one above the other on each longitudinal beam on the carrier-side. This results in the advantage that the length of the covering of each pair of side-wall elements can be matched to the size of the load or person required at this point. In the case of leads, which are of particularly awkward shape, opposing side-wall elements can be staggered relative to each other and then joined together. In both the back-pack and in the sled application it is advantageous, if the carrier-side longitudinal beams are at a greater distance from each other than the longitudinal beams on the load-side since this will result in a trough-like configuration.

In a preferred embodiment, the upper end section of each load-side longitudinal beam is bent out of the sliding plane on the carrier-side, with the end sections being connected by an end-side cross beam.

The spatial arrangement of the longitudinal beams, with holding elements on the narrow sides, also permits a preferred embodiment in which a slide plate is arranged between the longitudinal beams on the load-side, which makes it even simpler to use the apparatus as a sled, particularly in roadless terrain. It is preferred that the slide panel of an elastic and flexible plastic, so that the longitudinal beams on the load-side form reinforced edge runners, this providing directional stability on steep slopes. In order to prevent the excessive ingress of snow into the load area on the carrier-side, it is also foreseen that the slide plate be curved upwards on the narrow sides of the back-pack frame. In this regard, openings can be left on the longitudinal narrow sides, forming handholds on the longitudinal beams on the carrier-side.

In a further embodiment it is foreseen that on the narrow side at the coupling end the slide plate has an edge strip that is inclined obliquely upwards and protrudes freely between two cross members and which, on the opposite side, is fixed to the cross beam. This makes connector devices on the slide plates unnecessary since the raised edge strips rest against each other. The point of contact is thus curved upwards and formed at the location of the greatest ground clearance, at which location it has the smallest effect on the sliding characteristics. Since the back-pack frame according to the invention can also be used for military purposes, in this embodiment primarily the configuration of the slide plate can also be made so as to be bullet- and fragmentation-proof, possibly by woven textile inserts such as are used for military helmets.

A slide plate that is of plastic can be thick enough that the longitudinal beams on the load side can be embedded in its edge areas to act as reinforcements. Since this slide plate is to be extremely strong for a very low weight, it can, for example, be laminated, with the outer layers consisting of a glass-fibre reinforced thermosetting plastics that is hardenable by ultraviolet irradiation and the inner layer consisting of polyurethane foam. In this version, too, the slide plate can be rendered bullet- and fragmentation-proof by textile-like inserts.

It is preferred that each holding element be formed in the area of a cross beam that combines the carrier-side longitudinal beam and the load-side longitudinal beam on the narrow side. In this regard, a preferred embodiment foresees that each holding element is formed by a hollow cross beam joining the two longitudinal beams, and which has an insertion opening on the load-side, with the cross beam rising on the load-side, and in that each end piece of the shackle forms a peg that can be inserted into the holding element. When the apparatus is used as a rucksack, this makes it possible to dispense with the special fixing for the shackle. The angle of the rising cross beam preferably amounts to 10° from the horizontal. For use as a sled, the shackle can be removed and inserted so as to form a grip for pulling the sled. To this end, for example, ski poles can be secured to the shackle or to the carrier frame by means of straps or belts. A push connection for the pull handle can be achieved, if the upper end sections of the load-side longitudinal beams have openings, and the end sections, the cross beams and the insertion pegs of the shackle are in the same spatial arrangement relative to each other, e.g., in that they diverge slightly.

In a further embodiment it is foreseen that the two carrier-side longitudinal beams have at least one support as holding elements for the shackle that protrudes beyond the load-side longitudinal beams, in which this can be inserted.

Each support can, however, be formed by a V-shaped bend that extends on the load-side of the carrier-side longitudinal beam, in which connection the area that is bent is supported through the cross beam on the adjacent load-side longitudinal beam. A shackle that is particularly suited for this purpose is angled obliquely and provided with U-shaped end hooks. For use as a sled, this embodiment of the shackle can be installed at the front end of the carrier-side longitudinal beams.

In both of the embodiments of the shackle described above, its two side arms are provided with a connector or cross piece that rests against the load-side longitudinal beams or the slide plate.

The side-wall elements that are of flexible, in particular, textile, material are, for example, overlapping in order to form the covering, and are provided with conventional connecting elements such as belts, straps, buckles, or the like. The circumferential length of the covering can be matched to a very considerable degree to the load that is to be transported, if at least one of each pair of side-wall elements that are opposite to each other has a fold-out extension piece and the free edge strips of the extension piece and a longitudinal strip that is adjacent to the fold edge form overlapping connection areas, in which there are connecting elements. Here, velcro-type strips are particularly well suited as these connecting elements. The enclosure length of the side-walls is preferably such that when a casualty is being transported these overlap each other to secure the casualty so that they are at least in part double-walled. This forms an additional and very welcome thermal insulation.

A preferred embodiment for arranging two back-pack frames in series, end-to-end, provides that the lower end sections of the two longitudinal beams of each narrow side end in a common coupling, which is formed on one narrow side as a female coupling and on the other narrow side as a male coupling that can be inserted into the female coupling, this providing for a tension-proof connection of the coupling pieces.

This makes additional coupling elements on the parts of the coupling unnecessary, since the carrying strap sections have to be provided with connector elements such as buckles or the like, these being superfluous, when the apparatus is employed as a sled. In this way, two or two times two back-pack frames can be arranged so as to be adjacent to each other and then connected. The carrying strap sections used for the tension-proof connection can be passed within the coupling pieces, if both coupling pieces are configured so as to be tubular, and both longitudinal beams end in recesses formed in the outer sides.

The coupling pieces create very little resistance to sliding, if the end section of each load-side longitudinal beam that ends in a coupling section is angled on the carrier-side.

When the two back-pack frames are inserted into each other for use as a transport or rescue sled care should be taken to ensure that no snow can get into the load area at the point of contact of the slide plate. To this end, each embodiment, in which the slide plate is of resilient plastic foresees that the free edge strips of the slide plate are longer than the half insertion length of the insert section.

The two free edge strips, which are elevated obliquely towards each other bend elastically still more, when this connection is completed and are thus pressed into each other so that there is a useful sealing at the point of contact, which will be retained even if the tension-proof connection is loosened slightly during use.

Instead of using belts or straps to connect the coupling pieces it is far more favourable, if these coupling pieces enter into immediate detent. To this end, a preferred embodiment foresees that the insertion section has in its interior a spring tab that extends in the direction of insertion, the free end, of which forms a hook, and in that the coupling sleeve has a cross piece, on which these hooks can enter into detent, and in which the hook of the insertion section is accessible from the second, open side of the coupling sleeve. In order to release the connection, a rod or a finger can be used to spread two spring tabs from the second open side of the coupling sleeve, which then moves the hooks sideways away from the cross piece.

A further possibility for the immediate detent effect is seen, for example, in the fact that in the side-wall of the insertion section there is at least one locking pin that is installed so as to be sprung, in which connection the coupling sleeve has a corresponding hole for each locking pin.

The invention will be described below by way of example only with reference to the drawings appended hereto.

Figure 2:
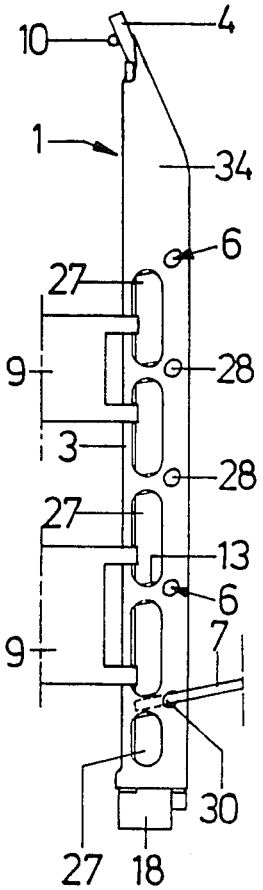
Figure 3:
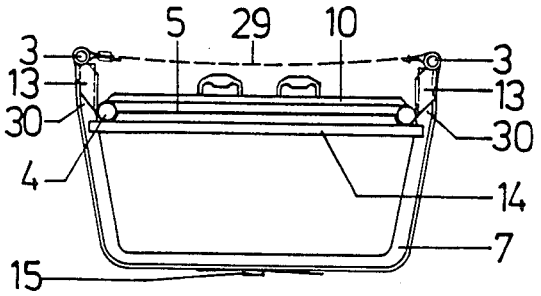
Figure 4:
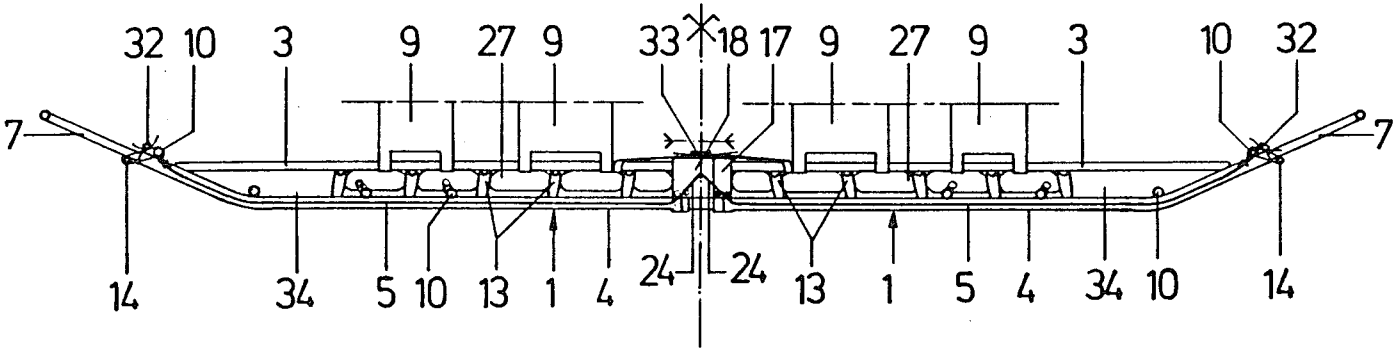
Figure 5:
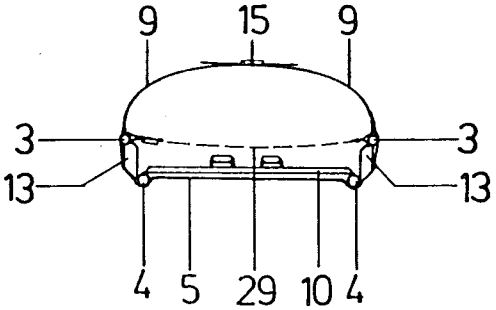
Figure 6:
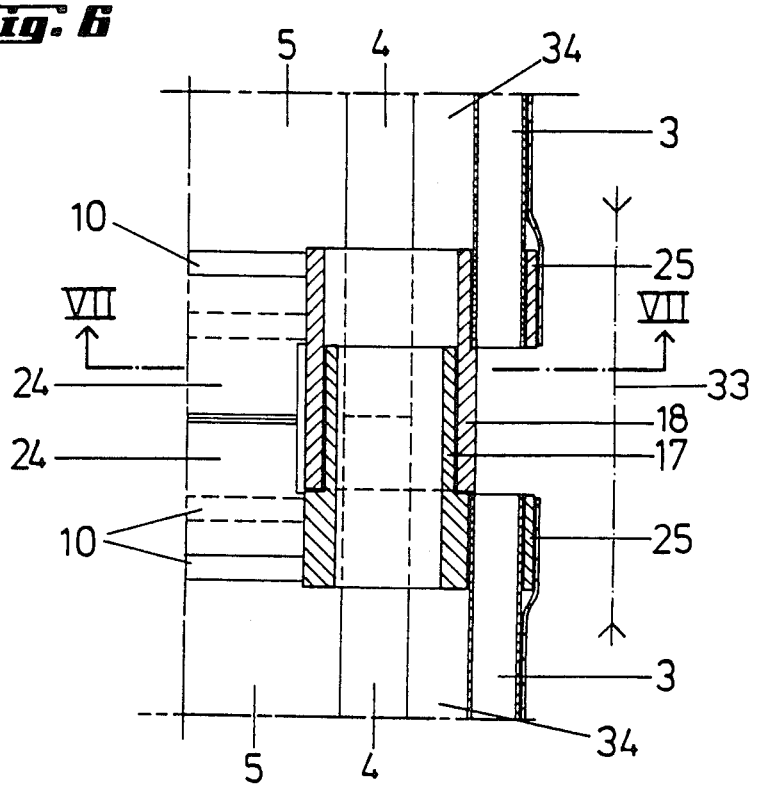
Figure 7:
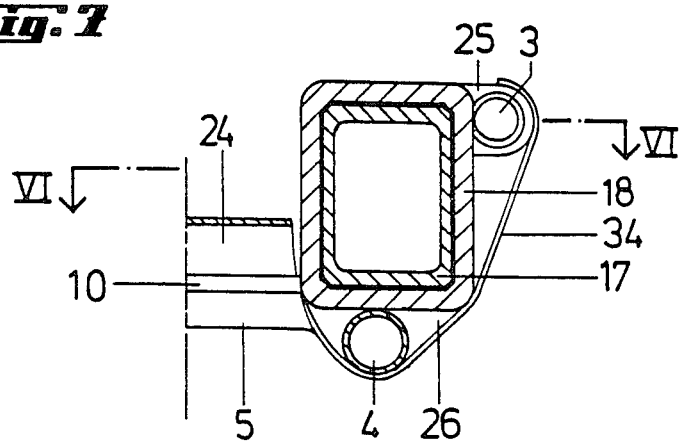
Figure 8:
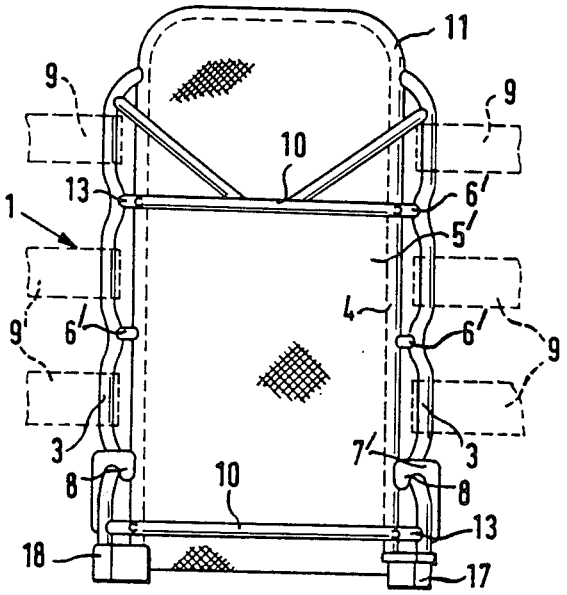
Figure 9:
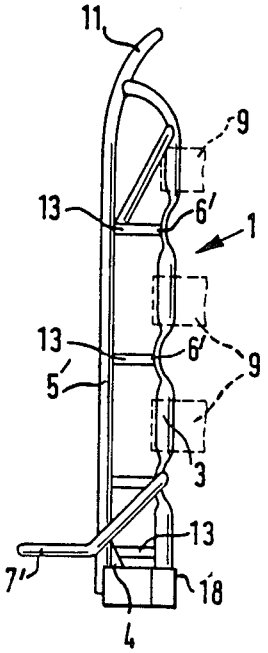
Figure 10:
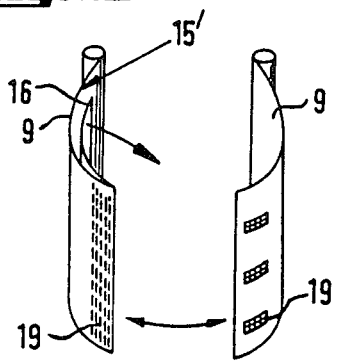
Figure 11:
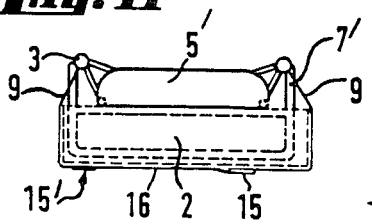
Figure 12:
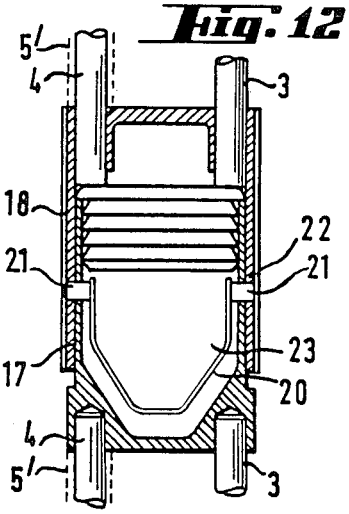
Figure 13:
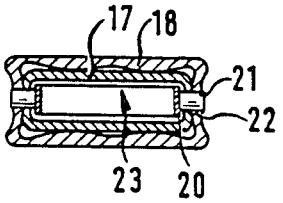
Figure 14:
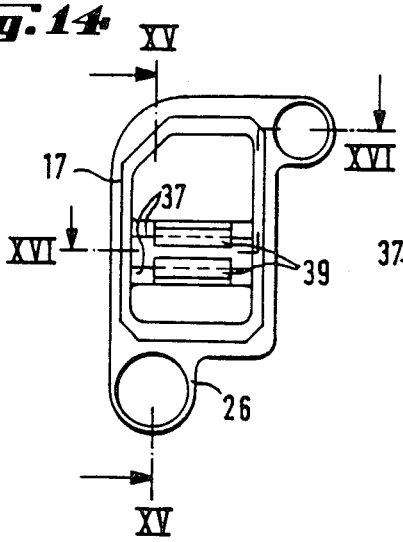
Figure 15:
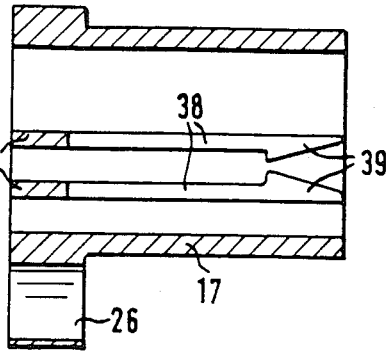
Figure 16:
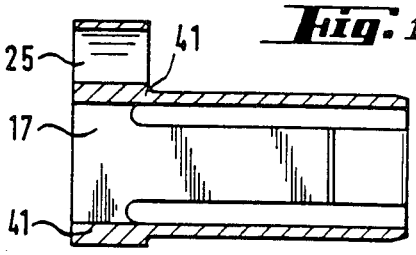
Figure 17:
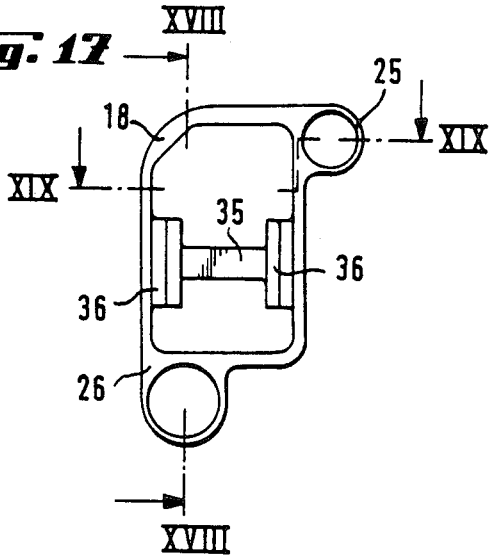
Figure 18:
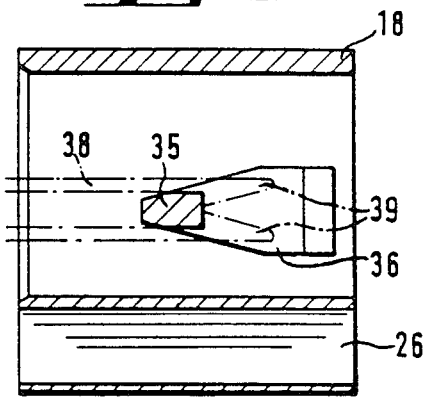
Figure 19:
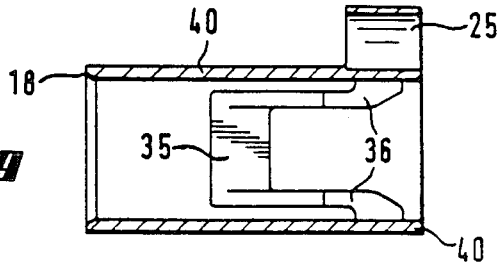

FIGS. 1 to 7 show a first embodiment of a back-pack frame according to the present invention, FIG. 1 showing a plan view on the carrier-side and FIG. 2 a side elevation of this, FIG. 3 is a cross section on the line III—III in FIG. 1 in the application used as a rucksack, FIG. 4 shows two of the back-pack frames combined so as to form a load carrying sled or a litter, shown in longitudinal section, FIG. 5 is a cross section of the application of a sled, and FIG. 6 and 7 show details of a simplest embodiment of the coupling in longitudinal and in transverse section, FIGS. 8 to 13 show a second embodiment of a back-pack frame according to the present invention, FIG. 8 being a plan view, FIG. 9 a side view, FIG. 10 showing a detail, to a larger scale, in an oblique view, FIG. 11 is a plan view of the application as a back-pack and FIGS. 12 and 13 show details of additional coupling elements in longitudinal and transverse cross section, FIG. 14 is a further embodiment of the inversion elements of the coupling in plan view on the insertion end, FIGS. 15 and 16 are cross sections on the lines XV—XV and XVI—XVI in FIG. 14. FIG. 17 is a coupling sleeve for this embodiment in plan view on the second open side, FIGS. 18 and 19 are cross sections on the lines XVIII—XVIII and XIX—XIX in FIG. 17.

The back-pack frame 1 has four longitudinal beams 3, 4 in a spatial arrangement that is defined by the edges of a prism with a trapezoidal basic shape (see FIG. 3, FIG. 12). The carrierside longitudinal beams 3 are arranged at a greater distance from each other than the load-side longitudinal beams 4. Between each carrier side and load-side longitudinal beam 3, 4 there are cross beams 13, and the load-side longitudinal beams 4 are connected to each other by cross bars 10. On the one side, the load-side longitudinal beams 4 form edge runners (see FIG. 5) and/or edge reinforcements (see FIG. 10) of a slide plate 5, 5', that is preferably of plastic and which has in its central portion additional guide ribs, middle runners, or the like, these not being shown herein. The front end sections of the load-side longitudinal beams 4 and the front part of the slide plate 5, 5' are angled in towards the carrier-side. The longitudinal beams 3, 4 terminate in couplings 17, 18 with the help, of which two back-pack frames 1 can be combined, as is shown in FIG. 4.

In the embodiment shown in FIGS. 1 to 7 the carrier-side longitudinal beams 3, preferably of circular cross section aluminium metal tubes, are provided with a plurality of holding elements 6 for shackles 7. Each of these holding elements 6 consists of a hollow transverse beam 13 that is welded to the outside of the load-side longitudinal beam 4, so that on the load-side there is an inclined socket (FIG. 3).

Because of the arrangement of the longitudinal beams, on the carrier-side there is a recess or trough, in which the carrying straps 31 (shoulder and waist straps), shown by the dashed lines in FIG. 1, can be arranged in the normal manner for back transport and then tightened. In addition, between the carrier-side longitudinal beams 3 there is a supporting net 29 or the like that is stretched so as to be adjustable in order to increase the degree of carrying comfort (FIG. 3) and comfort for a casualty (FIG. 5). A shackle 7 can be inserted in the socket of the hollow transverse beams 13 (FIG. 3). It is also conceivable that a plurality of shackles 7 can be arranged in stages one above the other. Each shackle 7 is basically U-shaped, with the side arms being angled out from each other and forming at their ends preferably parallel insertion sections 30, the length of these shackles 7 corresponding approximately to the length of a transverse beam 13. An additional cross piece 14 joins the side arms of the shackle. When the apparatus is used for back-packing, depending on the load 2 that is to be transported, the two insertion sections 30 of the shackle 7 are inserted into the transverse beams 13 that are opposite to each other at the desired height, the cross piece 14 then coming to rest on the load-side longitudinal beam 4 and thus the outer side of the slide plate 5. The centre section of each shackle 7 thus projects from the load-side. Now, a load (FIGS. 2, 3) can be placed upon the projecting portion of the shackle 7 that forms a floor. The side-wall sections 9 (FIG. 3), indicated in FIGS. 1 and 2 by dashed lines in the interest of greater clarity, are provided to fix this load. These side-wall sections 9 are of flexible material, for example sail cloth or a similar robust and weather-resistant material and are folded over at one end to form a sleeve or loop, or else releasably attached by means of straps and buckles. The connection 15 between the side-wall section 19 are similarly produced, for example, by means of straps and buckles. Each part of a carrier-side longitudinal beam 3 that is next to a holding element 6 can accommodate a movable side-wall section 9, i.e., the section of the longitudinal beam 3 that passes through the loop of the side-wall section 9 serves as a pivot axis for the side-wall section 9. In this way, the side-wall sections 9 can be closed in pairs on either the load or the carrier side so as to form a covering (FIGS. 3, 5). It is preferred that there be four side-wall sections 9 for each longitudinal beam 3, of which two are shown in FIG. 1 and FIG. 2.

The slide plate 5 that is bent down on the carrier-side at its upper end extends above the head of the carrier. Because of the division of the side-wall into three or four side-wall sections 9 even loads that are of very different circumferences and various levels or which are broken down into several parts and carried by a plurality of shackles 7 can be fixed in each covering section so as to be secure and close together since the degree of overlap of each individual side-wall section pair is variable. In the same manner a solid connection of side-wall sections that are staggered in height is provided, if a load having an irregular outside shape is to be carried.

Once the shackles 7 have been removed the back-pack frame 1 can be used as a sled without any alterations, for example, for the ground transportation of a load. In this connection, the side-wall sections 9 serve to secure the load, with the same connector elements being used (FIG. 5).

Additional advantages of the basic design become plain, when the apparatus is used as a sled. The slide plate 5 forms a completely enclosed sliding surface, and since the shackles 7 are affixed to the narrow side no portion extends beyond the sliding plane towards the outside. As is shown in FIG. 4 the shackle 7 that has been removed can be reinserted at the front end of the back-pack frame 1 and fixed in position by means of a strap or the like, to serve as a towing shackle. The raised end section of the slide plate 5, which is of plastic, results in a lower sliding resistance on either side. Since the middle area of the slide plate 5 between the loadside longitudinal beams 4 is arched upwards somewhat the edge runners serve to provide greater directional stability.

In order to form an enlarged transportation sled, as may be required to transport a casualty or to form a litter, two back-pack frames 1 are joined together (FIG. 4). The coupling is produced from two couplings that are inserted into each other (FIGS. 6, 7). Each back-pack frame 1 has on the one side a female coupling 18, and on the other side a male coupling 17 and these engage one another alternately, when the two apparatuses are combined, since the two back-pack frames 1 are assembled to be mirror images of each other.

In cross section, both coupling elements are approximately rectangular and have side recesses 25, 26, into which the two ends of both longitudinal beams 3, 4 are inserted. Since the male section 17 is also configured in the form of a sleeve a coupling 33 that is resistant to tension can extend through the coupling elements. This tension-resistant connection 33 can be achieved by means of straps or portions of the carrying straps 31, which are not otherwise required, when the apparatus is used as a sled, although however it is preferred that self-locking versions as shown in FIGS. 12,13 or 14-19 be used. In this embodiment in particular a slide plate 5 of flexible elastic material is used and this plate 5 is provided on the coupling side with an edge strip 24 that extends freely and obliquely between two cross beams 10; this edge strip 4 protrudes into the end halves of the coupling elements. When the two back-pack frames 1 are inserted into each other the two edge strips 24 of the two slide plates 5 rest against each other and bend upwards so as to form an essentially tight joint which, above all else, prevents the ingress of snow into the transportation space.

Securing the "Load" on the carrier-side as is shown in FIG. 5 is of particular importance, when transporting a casualty, since the wounded person can be secured several times by means of the side-wall sections 9 in a manner suitable for the body, and a warming covering is achieved simultaneously. Since at least one shackle 7 is provided for each back-pack frame 1, a traction or holding bar can be formed at both ends, in that the shackle 7 is inserted into the open raised ends of the load-side longitudinal beams 4. In this instance, too, a connection 32 can be produced by means of belts, bands, straps, or the like, which will encircle the end cross beam 10 of the back-pack frame 1 and the connector piece 14 of the shackle 7. Then, ski poles, for example, can be secured to the traction or holding bar so as to form an akia, or rescue sled. The bed surface is formed by adjustable parts of the carrier straps 31 as well as the net or mesh insert 29 (FIGS. 3, 5) for the back-transport mode. The sliding characteristics on snow are scarcely impaired by the join at the point of contact, since this is not in the sliding plane.

The bed surface can also have continuous padding or upholstery. On the narrow side of the back-pack frame 1 the slide plate 5 is raised and preferably fixed to the carrier-side longitudinal beams 3. Openings 28 for the shackle 7 are provided in these raised side portions 34 at the locations of the cross beams 13 and there are also hand holds 27, so that the two back-pack frames 1 that have been joined together are relatively easy to handle when used as a litter. Parts of the carrier straps 31, which are also passed through the hand holds 27 and can be secured to the carrier side longitudinal beams 3, can also be provided with eyelets, so that four elements of this kind make it possible to suspend the apparatus on the winch-line hook of a helicopter.

In the second version, as shown in FIGS. 8 to 13, the slide plate 5' is of reinforced, preferably laminated, plastic and the load-side longitudinal beams 4 are imbedded in the longitudinal edges of the slide plate 5'. The front portion of the slide plate 5' is bent up towards the carrier-side in the manner of a ski tip. The rear or lower end sections of the load-side longitudinal beams 4 are angled on the carrier-side, which means that once again the load-side and a carrier-side longitudinal beams 3, 4 end in couplings 17, 18. The slide plate 5' can also be angled in the coupling area so as to match the longitudinal beams 4.

The carrier-side longitudinal beams 3 are provided with a plurality of supports 6' that are formed by V-bends on the load-side, in which connection each bent area is directly supported by one of the cross beams 13. The supports 6' formed by these V-bends serve as holding elements for one or more shackles 7'. Each shackle 7' is basically U-shaped, in which connection the side elements are angled and are bent so as to form hooks 8 at their free ends, and these are then hooked onto the V-bends. The connector piece 14 is provided in the area of the bends and this is intended to rest on the load-side longitudinal beams 4 and thus the outer side of the slide plate 5'. Within the overlapping connector areas 15 the side-wall elements 9 are provided with velcro-type strips 19, in which connection in order to provide a two-dimensional variation of the closure, the velcro strips 19 of the two connector areas 15 that are to be overlapped are rotated through 90° relative to each other. (In FIG. 10, the velcro strip 19 of the left side-wall element 9 are, of course, provided on the inner side).

The version of the left side-wall element 9 that has an extension piece 16 that is folded inwards, as is shown in FIG. 10, is suitable for use with over-size loads. An overlapping connector area 15 is thus provided adjacent to the fold line on the side of the extension piece 16 that is folded to the inside, and a further connector area 15' is required along the free edge of the extension piece 16 on the side that faces the side-wall element 9, if an oversize load is to be enclosed as is shown in FIG. 11. Thus it is best to have velcro-type strips 19 on the inner side of the left side-wall section 9 in FIG. 10 to fix the folded-in extension piece 16 since, as has been described, at this point there is an overlapping connector area 15'. Of course, the right-hand side-wall element 9 could also be provided with an extension piece 16 and have additional extension pieces 16 that are folded in on both side-wall sections 9. When used as a sled, the side-wall elements 9 can be closed by the velcro-type strips 19, since the overlapping alternates, i.e., the overlapping side-wall element 9 shown in FIG. 11 on the outside will then be on the inside.

As has been discussed, the slide plate 5' that is raised at the end, is preferably laminated from fibre reinforced plastic and, when used for military purposes, can have additional inserts to render it bullet- and splinter-proof, in which regard the end of the slide plate 5 that bends forward to provide head cover when used in the back-pack mode is particularly appropriate. Thus, for example, it can be made up of a glass-fibre reinforced thermosetting plastic outer layer with a polyurethane foam core.

FIGS. 12 and 13 show a first embodiment of the self-locking coupling. In cross section, the coupling sleeve 18 is approximately rectangular, in which connection the ends of both longitudinal beams 3, 4 are inserted into the coupling sleeve on the carrier-side. A hole 22 is provided in each narrow side. The male element 17, in which both longitudinal beams 3, 4 of the other side's end, has a covered space 23, in which there is a U-shaped spring 20 these having at both ends a locking pin 21 that protrudes outwards. On insertion the locking pins 21 enter into detent in the holes 22 this resulting in the connection of the two back-pack frames 1. By pressing in the locking pins 21 these two assemblies can be separated very easily.

FIGS. 14 to 19 show a second embodiment of a self-locking coupling. The male section 17 and the female sleeve 18 correspond essentially to the coupling pieces used in the embodiment shown in FIGS. 1 to 7, i.e., both are in the form of sleeves and have side recesses 25, 26, in which the longitudinal beams 3, 4 end. A cross piece 35 is formed at the approximate centre of the coupling sleeve 18 and this joins the spring side elements 36. On the side of coupling sleeve 18 that is connected with the longitudinal beams 3, 4, these project from its side-walls 40. The cross piece 35 is retained by hooks 39, when the male section 17 is inserted (FIG. 18); these hooks 39 have spring tabs 38 at their ends. The spring tabs 38 extend along the whole length of the male section 17 and protrude form the cross pieces 37, which on the side of the coupling element 17, which is connected to the longitudinal beams 3 and 4, join its side-walls 41.

Since the coupling sleeve 18 is also open on the carrier-side, the tabs 38 that are in detent can also be spread from this side so that the connection can be released once again. In addition, tabs 38 that bear the hooks 39 can be secured against undesired spreading in that, for example, a cap, a slide or the like, not shown herein, can be provided, this being secured on the male element 17 or on the female element 18 so as not to twist.

Thus, the back-pack frame 1 according to the present invention is a combinable multi-function apparatus in which, in each of its individual functions (backsack, possibly with additional thigh belts, sled, litter) is a significant approximation to a specialized apparatus in regards to the achievement of an application-specific role.

We claim:

1. A frame for carrying loads, to be used as a back-pack frame or a sled, said frame comprising:

four longitudinal beams provided in a spatial arrangement so as to correspond approximately to the edges of a prism said four longitudinal beams forming a first pair of longitudinal beams which define a carrier side of the frame and a second pair of longitudinal beams which define a load side of the frame, when used as a back-pack and a sliding plane when used as a sled, each longitudinal beam of said first pair combining with an adjacent longitudinal beam of said second pair to define a narrow side of the frame, said four longitudinal beams being arranged in such a manner and having means for enabling two such frames to be connected end-to-end so as to form a platform that can either be carried or pulled along the ground;

cross beams connecting said second pair of longitudinal beams;

load securing elements being arranged on the carrier side longitudinal beams, being made of flexible material, and being connectable to each other on the carrier side as well as on the load side to enclose the load outside the spatial arrangement of the longitudinal beams;

at least one holding element being provided on each of the two narrow sides of the frame at a distance from said sliding plane so as to not lie in or interrupt the sliding plane;

at least one load supporting shackle extending beyond said sliding plane when used as a back-pack and having two sides that are removable held by a pair of said holding elements; and carrying straps arranged on the carrier side of the frame.

2. The frame as in claim 1, wherein said first pair of longitudinal beams are spaced farther apart than said second pair of longitudinal beams.

3. The frame as in claim 1, wherein each of said second pair of longitudinal beams includes an upper end section which is bent out of the sliding plane toward said first pair of longitudinal beams, the bent end sections being connected by a first cross-beam.

4. The frame as in claim 3, further comprising a slide plate arranged on the second pair of longitudinal beams.

5. The frame as in claim 4, wherein, when the frame is used as a sled, the second pair of longitudinal beams forms edge runners of the slide plate.

6. The frame as in claim 4, wherein the slide plate extends over each narrow side of the frame and is secured to said first pair of longitudinal beams to form side portions, said side portions of the slide plate having openings therein for enabling said first pair of longitudinal beams to be held.

7. The frame as in claim 4, wherein the slide plate is made of plastic and the second pair of longitudinal beams form edge reinforcements arranged within the slide plate.

8. The frame as in claim 7, said slide plate comprising two layers of glass-fibre reinforced thermosetting plastic that is hardenable by ultraviolet irradiation, and an inner core of polyurethane foam.

9. The frame as in claim 4 wherein a pair of cross beams connect the second pair of longitudinal beams on the ends of said second pair of longitudinal beams which are opposite to said upper end sections and the slide plate has a first end strip that is fixed to said first cross beam and an obliquely raised second end strip that protrudes freely between said pair of cross beams.

10. The frame as in claim 1, wherein there is provided at least one narrow side cross beam that connects a longitudinal beam of said first pair and a longitudinal beam of said second pair, each holding element being provided on a narrow side cross beam.

11. The frame as in claim 10, wherein each holding element is formed of a narrow-side cross beam that is hollow, that rises to the load-side longitudinal beam, and that has an insertion opening, the shackle having side arms each of which has an end piece forming an insertion peg that is insertable into the holding element.

12. The frame as in claim 11, said second pair of longitudinal beams including upper end sections also comprising insertion openings, the end sections of said second pair of longitudinal beams, the holding elements and the insertion pegs of the shackle being arranged so that the insertion pegs of each shackle can be inserted into both the insertion openings of the holding elements and the insertion openings of the end sections of said second pair of longitudinal beams.

13. The frame as in claim 1, wherein the shackle has side arms and each of said first pair of longitudinal beams has at least one support as a holding element for a side arm of the shackle that projects beyond said second pair of longitudinal beams and in which it can be installed.

14. The frame according to claim 13, wherein each support is formed by a load-side bend in said first pair of longitudinal beams, and wherein there is provided a narrow side cross beam to support the bend.

15. The frame as in claim 13, wherein each side arm of the shackle is angled and provided with a U-shaped end hook.

16. The frame as in claim 1 wherein the shackle has side arms which are connected by a cross-piece being adapted to rest on the load side of the frame.

17. The frame as in claim 1 wherein at least a first load securing element comprises a fold-out extension piece having a free edge strip, a fold edge, and a longitudinal piece that adjoins the fold edge, the free edge strip and the longitudinal piece forming overlapping connection area which are provided with connector elements.

18. The frame as in claim 17, wherein hook-loop fastener strips are provided as connector elements, whereby the hook-loop fastener strips of the connecting area of the first load securing element extend at an angle of 90° to those of the connecting area of a second load securing element.

19. The frame as in claim 1 wherein said means for enabling two frames to be connected comprises a pair of tubular coupling means, one coupling means being formed as a female coupling sleeve the other as a male plug that can be inserted into the coupling sleeve, producing a tension-proof connection for the coupling means, each coupling means having outside recessed portions receiving lower end sections of a load side and a carrier side longitudinal beam.

20. The frame as in claim 19, wherein the male plug has in its interior at least one spring tab that extends in the direction of insertion, the free end of said tab forming a reverse hook, and wherein the coupling sleeve has a cross-piece around which the reverse hook enters into detent, the reverse hook being accessible from a second, open side of the coupling sleeve.

21. The frame as in claim 19, wherein at least one locking pin is installed in the side wall of the male plug so as to be sprung, the coupling sleeve having one corresponding hole per coupling pin.

22. A method of carrying loads comprising:

providing a frame constructed of four longitudinal beams provided in a spatial arrangement so as to correspond approximately to the edges of a prism and forming a first pair of longitudinal beams, defining a carrier side of the frame and a second pair of longitudinal beams, defining a load side, when used as a back-pack and a sliding plane when used as a sled, each longitudinal beam of said first pair combining with an adjacent longitudinal beam of said second pair to define a narrow side of the frame, said four longitudinal beams being arranged in such a manner and having means for enabling two such frames to be connected end-to-end so as to form a platform that can either be carried or pulled along the ground; cross beams connecting said second pair of longitudinal beams; load securing elements being arranged on said first pair of longitudinal beams, being made of flexible material, and being connectable to each other on the carrier side as well as on the load side to enclose the load outside the spatial arrangement of the longitudinal beams; at least one holding element being provided on each of the two narrow sides of the frame at a distance from said sliding plane so as to not lie in or interrupt the sliding plane; at least one load supporting shackle extending beyond said sliding plane when used as a back-pack and having two sides that are removably held by a pair of said holding elements; carrying straps arranged on the carrier side of the frame; and a pair of tubular coupling means, being formed as a female coupling sleeve and the other as a male plug that can be inserted into the coupling sleeve, producing a tension proof connection for the coupling means, each coupling means having outside recessed portions receiving lower end sections of a load side and a carrier side longitudinal beam; and connecting two such frames end-to-end by inserting said male plug coupling means of a first frame into said female coupling sleeve of a second frame thereby forming a large transportation sled which can be dragged along the ground or a platform that can be carried.

* * * * *